US005079473A

United States Patent [19]

Waymouth

[11] Patent Number: 5,079,473

[45] Date of Patent: Jan. 7, 1992

[54] OPTICAL LIGHT SOURCE DEVICE

[75] Inventor: John F. Waymouth, Marblehead, Mass.

[73] Assignee: John F. Waymouth Intellectual Property and Education Trust, Marblehead, Mass. ; c/o John F. Waymouth

[21] Appl. No.: 404,859

[22] Filed: Sep. 8, 1989

[51] Int. Cl.[5] ..... H01J 17/06; H01J 5/16; H01K 1/26

[52] U.S. Cl. ..... 313/112; 313/618; 313/632; 313/315

[58] Field of Search ..... 313/618, 112, 632, 315

[56] References Cited

U.S. PATENT DOCUMENTS 2,014,858 9/1935 McKay ..... 313/618 X 3,662,214 5/1972 Lustig ..... 313/618 X

*Primary Examiner*—Palmer C. DeMeo

*Attorney, Agent, or Firm*—Edward A. Gordon

[57] ABSTRACT

An optical light source device includes a source member providing the emission of electromagnetic radiation wavelengths in the optical region of the spectrum, and at least one cavity waveguide member coupled with the electromagnetic radiation source member having a predetermined lateral dimension. The cavity waveguide member and predetermined dimension restrict the emission of electromagnetic radiation in the long wavelength non-visible infra-red range. In a preferred embodiment, the optical light source is formed with an array of optical light source members and associated cavity waveguide members.

20 Claims, 6 Drawing Sheets

| TEMP. DEG. K | LM/CM$^2$ | W/CM$^2$ (NOTE 1) | LPW | EVAPRN MICRONS/ 10,000 HRS. |
|---|---|---|---|---|
| 1800. | 36.7 | 1.42 | 25.9 | 1.11E-6 |
| 1900 | 75.5 | 1.86 | 40.6 | 2.61E-5 |
| 2000 | 145. | 2.37 | 61.1 | 4.29E-4 |
| 2100 | 262. | 2.98 | 87.9 | 5.40E-3 |

FIG.8

OPTICAL LIGHT SOURCE DEVICE

FIELD OF THE INVENTION

The present invention relates to optical light source devices and more particularly to a new and improved optical light source device including a source of electromagnetic radiation and a cavity waveguide.

BACKGROUND OF THE INVENTION

A major impediment to the achieving of high luminous efficacy in artificial light sources is the fact that many systems for converting energy into visible light result in the emission of significant quantities of long wavelength infra-red light (to which the eye does not respond) at the expense of visible light of shorter wavelength.

The principal tools available to the developer of light sources have been first to raise the temperature of the radiating body, and second to seek radiating species that have limited emissions in the infra-red. Raising the temperature results in shifting the black-body radiation curve (which sets the upper limit to emission at any wavelength) towards shorter wavelengths, permitting radiating transitions producing visible light to be enhanced. The search for more refractory materials, operable at higher temperatures, has formed the basis for the enhancement of the efficiency of incandescent lamps from the extremely low value of the candle, to the improved gas mantle, to the carbon-filament incandescent lamp, to the present day tungsten-filament lamp. Each in turn was capable of achieving higher operating temperature, and each in turn had higher luminous efficacy, with a smaller and smaller fraction of the energy in the infra-red.

Achieving the excitation of radiating emitting species with few transitions in the infra-red is the basis of the technology of electric discharge lamps, in which the atomic or molecular species excited have only weak emissions into the infra-red, not reaching the blackbody limit, but strong transitions in the shorter wavelength regions of the spectrum.

Despite the clear advantage of tungsten filament incandescent lamps over their predecessors, the radiant emission from these sources is still 90% or more in the infra-red region, not perceived by the eye. Since the development of of the gas-filled tungsten filament incandescent lamp in the second decade of this century, no more-refractory materials capable of higher temperature operation in a light source have been discovered. Despite numerous advances in gas-discharge light sources, the most efficient sources have only a limited number of short wavelength transitions as well, and therefore are either limited in color rendition (low-pressure sodium lamps) or require a phosphor to convert ultraviolet light into visible at considerable loss of efficiency (fluorescent lamps).

It has been the custom to think of the radiative lifetime of an electronically excited state of an atom or molecule as a constant of the universe. However, this is only true when the atom is in free space and able to radiate to infinity with an infinite number of vacuum modes of the electromagnetic field into which to radiate.

Recent research has shown that radiative lifetimes may be in fact strongly modified. The central conclusion of the research, in a variety of configurations, may be called the Cavity Quantum Electrodynamic Principle. Excited states within or coupled to a reflecting cavity or waveguide can only radiate into allowed modes of the cavity or waveguide. In particular if the wavelength of the transition is greater than the cavity cut-off wavelength, the transition probability is zero. (See PHYSICS TODAY January 1989 "Cavity Quantum Electrodynamics" pages 24–30.)

It is well known to the prior art that the radiation from tungsten filament lamps includes only 5–10% of visible light energy, with most of the balance being in the infra-red. It is known to the prior art to operate such filaments for the sake of maximizing the fraction of visible radiation at the highest temperature permitted by the material, as limited by the vaporization of tungsten atoms from the surface. It is well known that as a consequence an inverse relationship holds between efficiency and life of tungsten filament lamps. The higher the efficiency, the shorter is the life.

It is known to the prior art to increase the luminous efficiency of gas flame lanterns by providing a so-called "mantle" in contact with the flame and heated by it to temperatures in the vicinity of 1500° K. The mantles known to the prior art are typically composed of thorium oxide to which a small percentage of cerium oxide has been added. By virtue of having few free electrons, and having a fundamental infra-red absorption/emission band onset at wavelength longer than 5000 nm, the ceramic body of the mantle is a relatively poor radiator of infra-red radiation. The incorporation of cerium adds absorption/emission transitions in the visible part of the spectrum, enhancing the luminous emission at 1500° K. Consequently such so-called "gas mantles" achieve luminous efficacies of 2 lumens/watt or thereabouts at 1500° K, very much more than the 0.2 lumens/watt that could be achieved with a tungsten radiator at that temperature. They are widely used in portable gas-fired lanterns for application where electricity is not available. However, it would be desirable in the construction of such mantles to dispose of the thorium-oxide cerium oxide ceramic body and at the same time increase the efficiency of such mantles.

Accordingly, a principal desirable object of the present invention is to overcome the disadvantages of the prior art.

Another desirable object of the present invention is to provide an energy conversion device which maximizes the conversion of such energy into visible wavelengths.

A still further desirable object of the present invention is to provide an energy conversion device which provides a source of artificial light while minimizing infra-red radiation to the extent that the radiating surface may be operated at a sufficiently lower temperature resulting simultaneously in an increase in efficiency together with an increase in life over incandescent lamps of the prior art.

A desirable object of the present invention is to provide an artificial optical light source which minimizes the emission of infra-red radiation while maximizing emission of visible radiation.

Another desirable object of the present invention is to provide a new and improved optical light source device including an electromagnetic radiation source member and at least one cavity waveguide member.

These and other desirable objects of the invention will in part appear hereinafter and will in part become apparent after consideration of the specification with reference to the accompanying drawings and the claims.

SUMMARY OF THE INVENTION

The present invention discloses a device providing a new and improved source of electromagnetic radiation in the optical region of the electromagnetic spectrum. The device is constructed and arranged to include a source of electromagnetic optical radiation having a wavelength range including visible and non-visible waves and at least one cavity waveguide coupled with the source of electromagnetic radiation whereby the cavity waveguide suppresses the propagation of electromagnetic radiation of longer-wavelengths, that is, for example, in the non-visible infra-red range.

BRIEF DESCRIPTION OF THE DRAWING(S)

For a fuller understanding of the nature and desired objects of the invention, reference should be had to the following detailed description taken in connection with the accompanying drawings wherein like reference characters denote corresponding parts throughout the several views and wherein.

Figure 3:
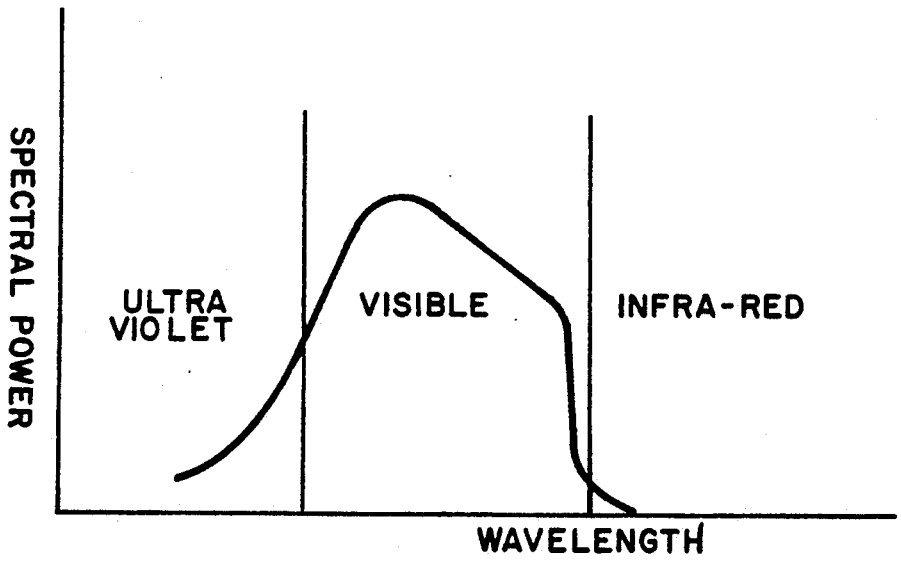
Figure 2B:
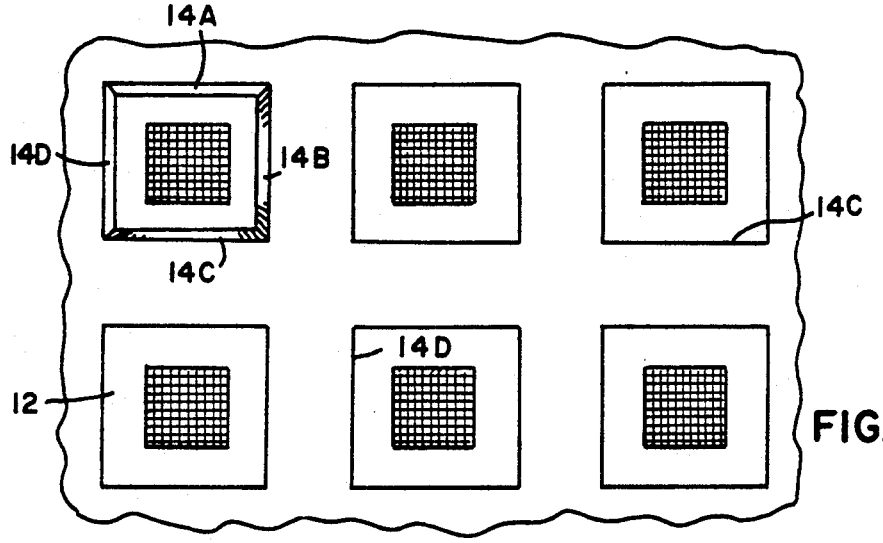
FIG. 2A is an enlarged fragmentary cross-sectional schematic representation of a high pressure xenon discharge lamp embodying principles of the present invention.
Figure 2A:
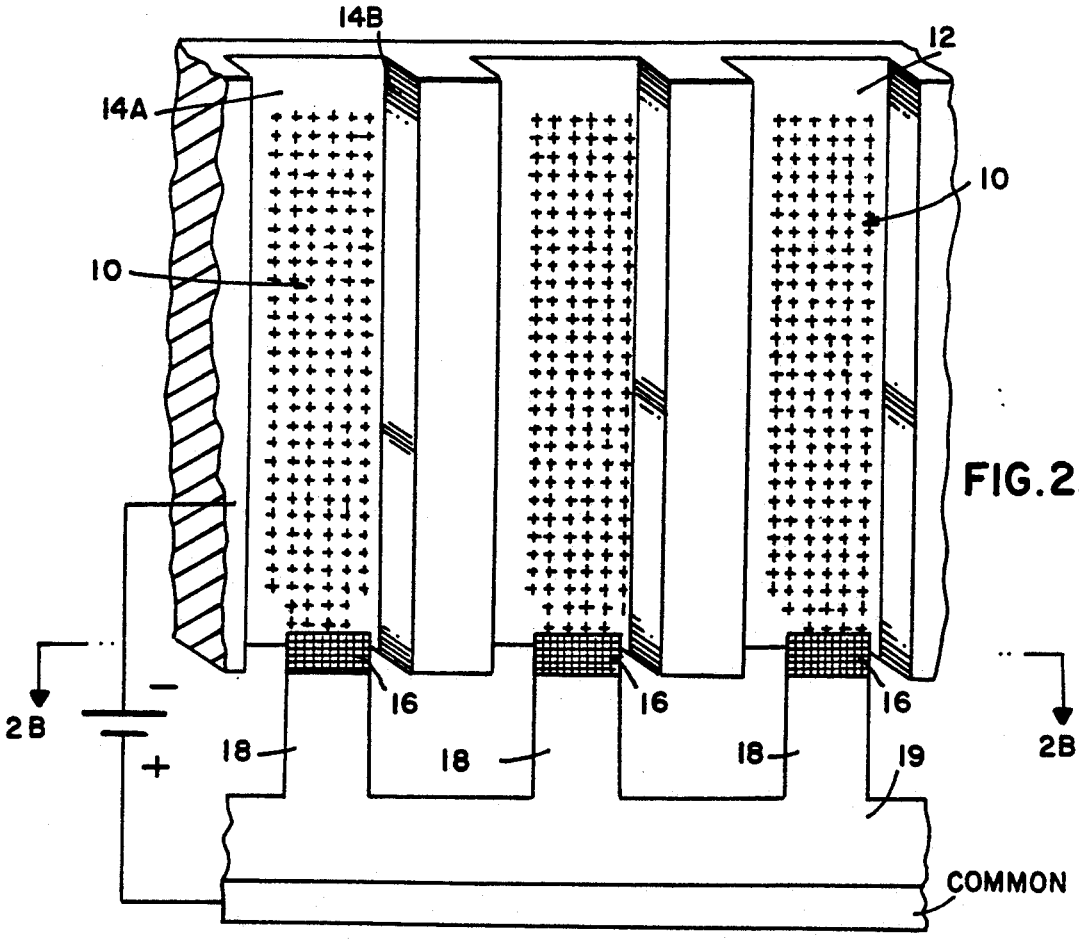
Figure 4A:
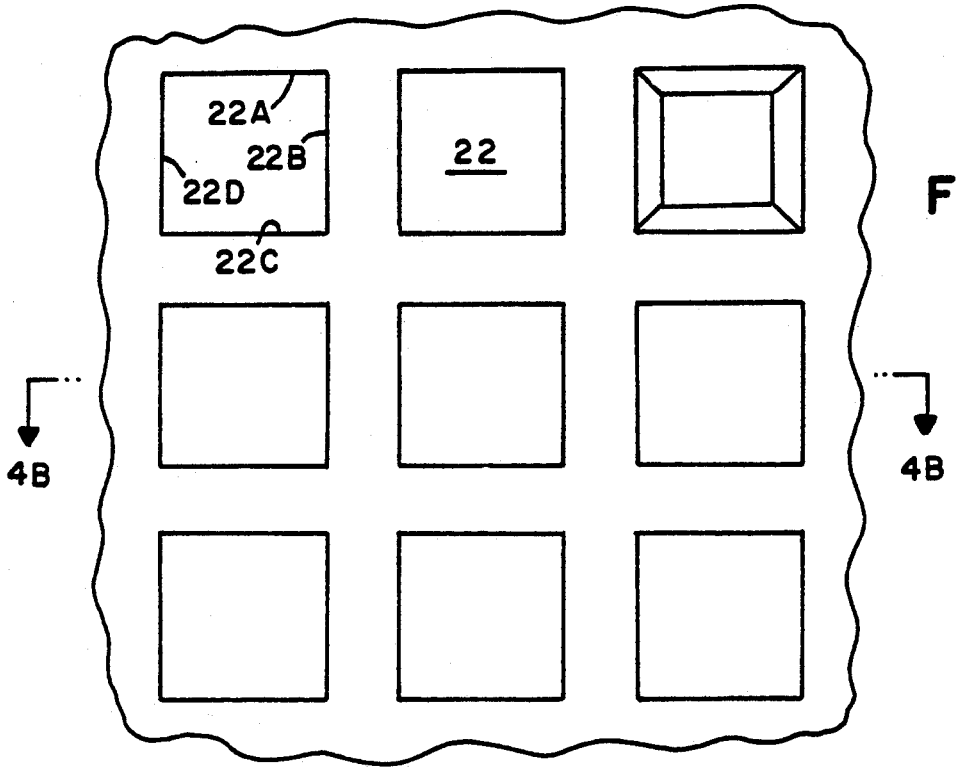
Figure 4B:
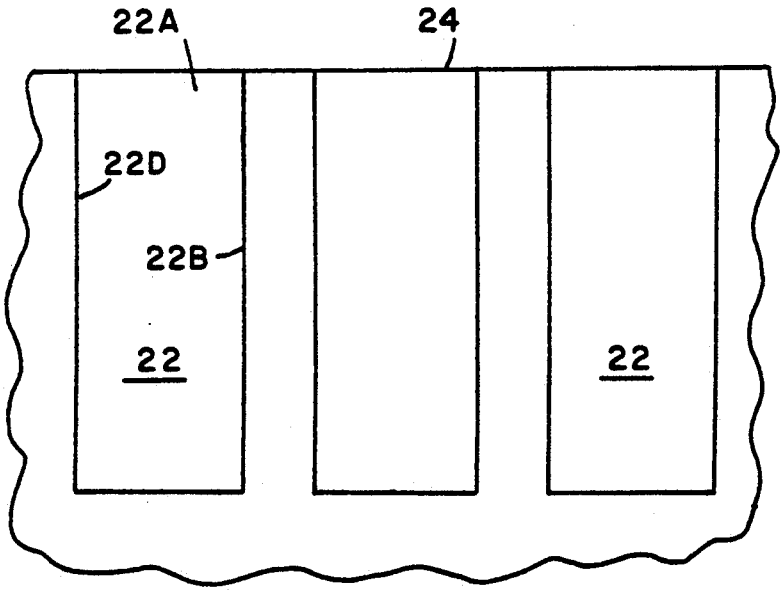
Figure 5:
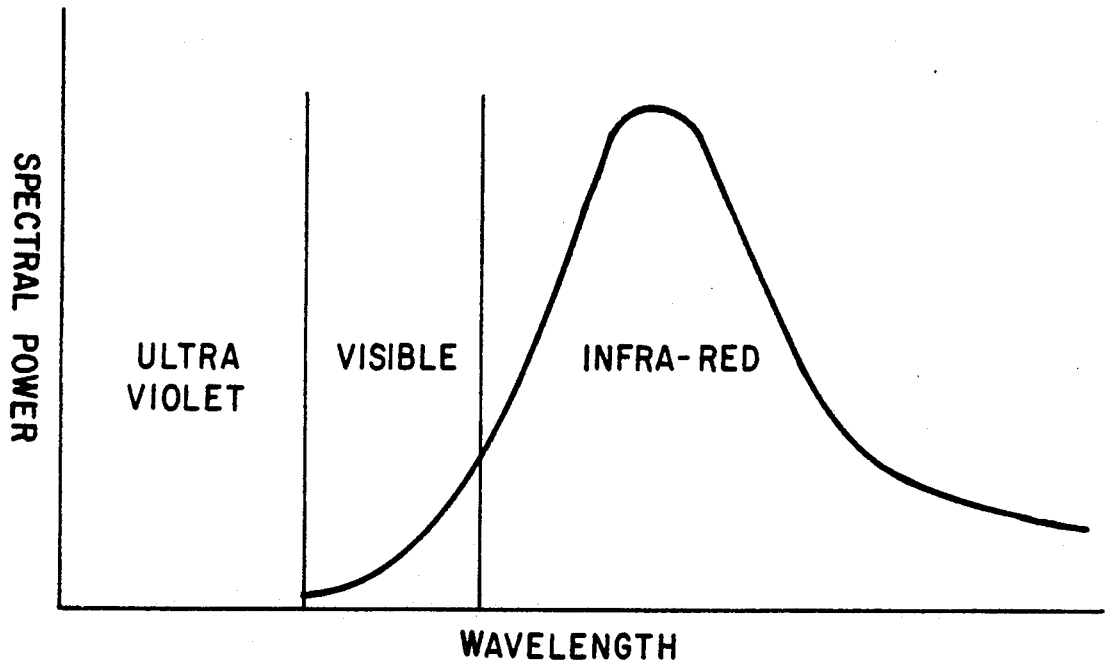
FIG. 5 (PRIOR ART)
Figure 6:
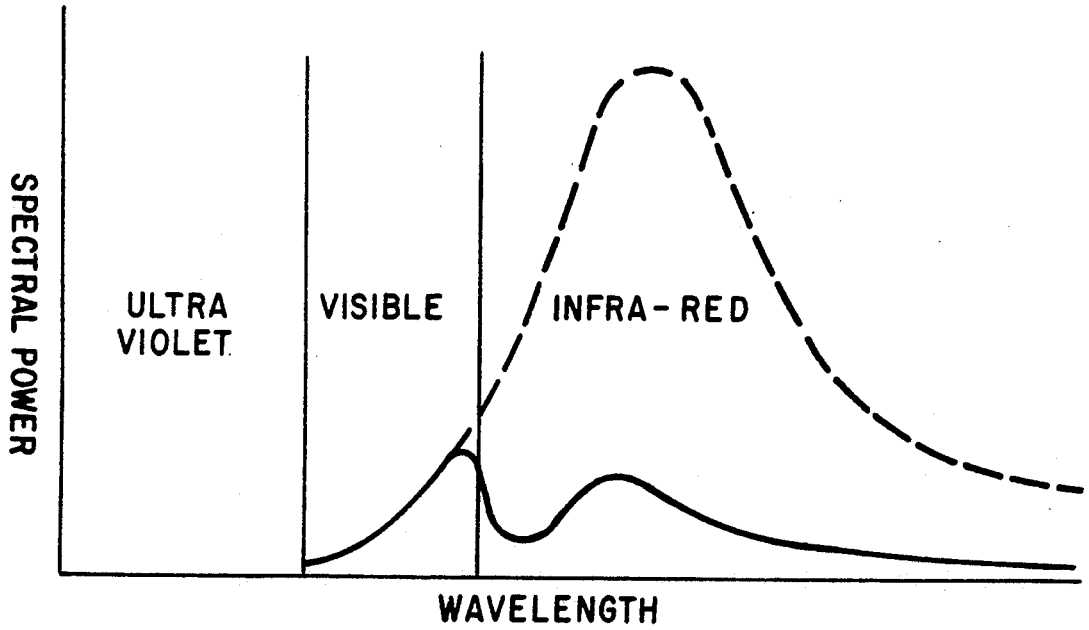
Figure 7A:
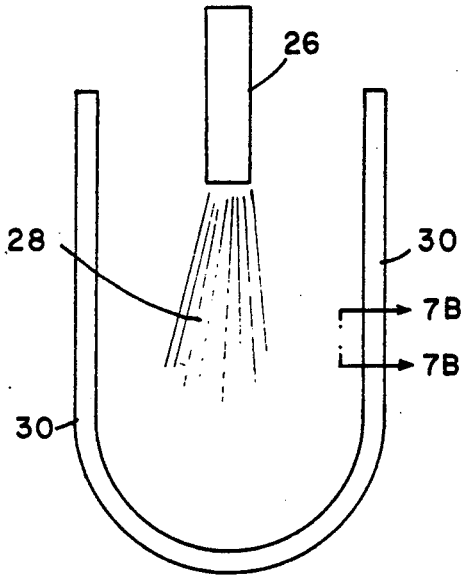
Figure 7C:
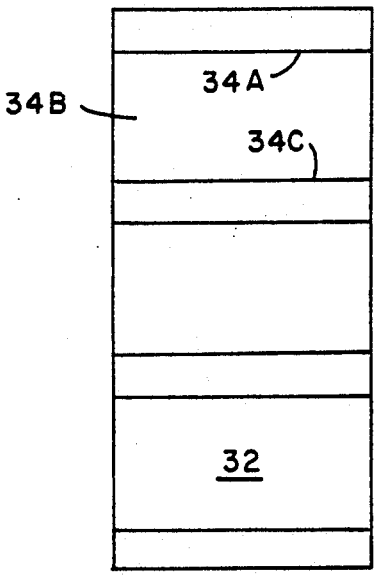
Figure 7B:
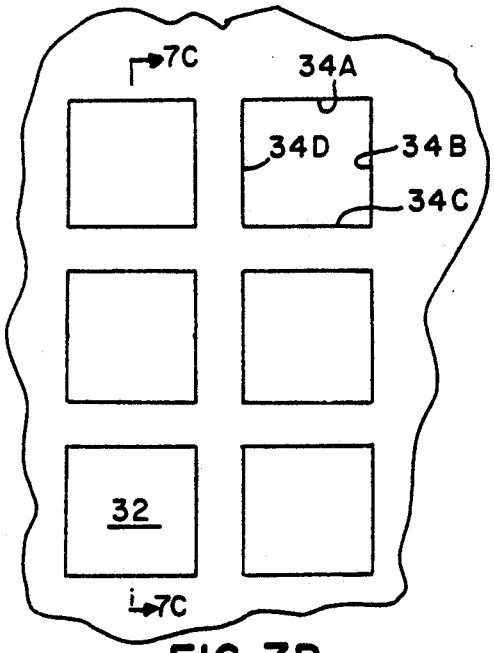

FIG. 2B an enlarged cross-sectional view taken along the line B—B of FIG. 2A;

FIG. 3 is a diagram of the wavelength emission spectrum of the high pressure xenon discharge lamp of FIG. 2;

FIG. 4A is a schematic top view of an array of waveguide cavities;

FIG. 4B is a cross-sectional view taken along the line B—B of FIG. 4A;

FIG. 5 is a schematic illustration of the spectral power distribution of radiation from a tungsten radiator according to the prior art;

FIG. 6 is a schematic illustration of the spectral power distribution of radiation from a tungsten radiator according to the present invention;

FIG. 7A is a schematic representation of an embodiment of incandescent gas mantle in accordance with the present invention;

FIG. 7B is an enlarged cross sectional view taken along the line B—B of FIG. 7A;

FIG. 7C is an enlarged cross sectional view taken along the line C—C of FIG. 7B; and FIG. 8 is Table 1.

DETAILED DESCRIPTION OF PREFERRED EMBODIMENT(S)

The invention will now be described with respect to the following embodiments:

EMBODIMENT 1 ELECTRIC DISCHARGE LAMP

Figure 1:
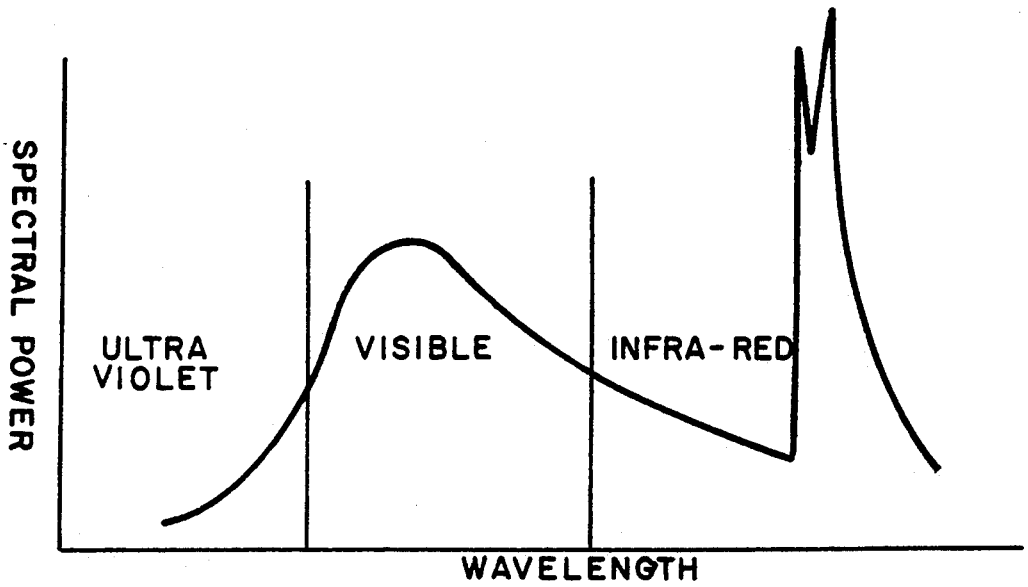
FIG. 1 (PRIOR ART)
FIG. 1 is a diagram of the wavelength emission spectrum of a prior art high pressure xenon discharge lamp.

Reference is made to the drawings and particularly to FIGS. 1-3. FIG. 2A and B illustrate the design for a high-pressure xenon discharge lamp in accordance with the present invention wherein there is provided a multiplicity of individual xenon discharge sources 10 arranged within elongated square waveguide cavities 12 each defined by lateral side members 14*a-d* each having a lateral dimension of 350 nm (as best in FIG. 2B) and length of 700 nm (as best seen in FIG. 2A). Each waveguide cavity 12 provides a cutoff wavelength of 700 nm and has no modes which permit the exodus of wavelengths greater than 700 nm. Therefore, the electronic transitions in the gas discharge plasma (xenon in this embodiment) which would result in the emission of infra-red wavelengths longer than 700 nm in free space are prevented from occurring in the waveguide cavity discharge.

Accordingly, the emission spectrum of the discharge lamp of FIG. 2 is, as shown in FIG. 3, similar to that of the prior art discharge lamp, as shown in FIG. 1, in the ultraviolet and visible, but is substantially improved because of the waveguide cavity discharge limitation at 700 nm, being substantially zero in the infra-red wavelength range. The advantage in luminous efficacy achieved by preventing the radiation o the infra-red in accordance with the present invention is believed t be readily apparent.

The elongated square waveguide cavities 12 of the discharge lamp of FIG. 2 are preferably formed by conventional semiconductor lithographic techniques to provide a perforated metal foil (for example, gold or silver) to serve as the multiplicity of waveguide cavities 12 and also as the "hollow"cathodes. The anode structure 16 for each cathode is fabricated by similar techniques to include for each waveguide cavity cathode an individual metallic anode 16 in series with an individual resistor ballasts 18 produced by semiconductor lithographic techniques from a layer 19 of resistive material such as, for example undoped silicon or lightly doped n-type silicon.

Each anode structure 16 must be positioned in register with the corresponding cathode structure 12. Thus all waveguide cavity discharges are individually ballasted and may be operated in parallel from a common power supply.

Each individual xenon discharge source 10 is arranged to operate in the conventional "hollow cathode, normal glow"mode. This is achieved in xenon at a value of pressure times dimension ("pd") to equal about 1 torr-cm. For the elongated square waveguide cavity 12 having about 7000 nm length and lateral sides 14 each of 350 nm dimension, this requires a xenon pressure of approximately 39 atmospheres. The maximum normal glow current in the rare gases is on the order of 1 microampere/$cm^2$ times (pressure in torr)$^2$. At 39 atmospheres, this is 816 amp/$cm^2$. The maximum current in the normal glow of each individual cavity discharge is approximately 79 microamperes. If the cavities 12 are on one-micron centers, there are $10^8$/$cm^2$, which would permit a total current in the normal glow mode of 7900 amperes/$cm^2$.

It is to be understood that the upper limit of current of the light source device of the present invention will be set by the ability of the structure to dissipate heat at much lower levels than the maximum normal glow current, unless the discharge were operated in a pulsed mode.

The specific embodiment of the high pressure xenon electric discharge lamp shown in FIG. 2 is merely by way of example. Other designs embodying the principles of the present invention may be employed. For example, other gases may be used. Also larger aperture waveguides of correspondingly longer cutoff wavelengths ma be used to give reduced infra-red radiation and hence higher efficiency than prior art, although not the best overall efficacy.

The terms "efficacy" or "luminous efficacy" used herein are a measure of the total luminous flux emitted by a light source over all wavelengths expressed in lumens divided by the total power input of the source expressed in watts.

EMBODIMENT 2 TUNGSTEN INCANDESCENT LAMP

By employing the principles of the present invention with respect to tungsten type incandescent lamps, there is provided an incandescent lamp which minimizes the infra-red radiation to the extent that the radiating surface may be operated at a much lower temperature which simultaneously provides an increase in efficiency and an increase in the operative life over the prior art tungsten type incandescent lamps.

To understand the application of the principles of the present invention to tungsten type incandescent lamps, it is believed helpful to review the processes involved in the generation of continuous spectrum radiation by an incandescent body such as a tungsten radiator.

The primary radiating process is the deflection of a moving electron in passing close to the nucleus of a tungsten atom. That deflection constitutes an acceleration which by Maxwell's laws results in radiation. Since the deflection and loss of momentum is not quantized, the photon energy is not either and continuous spectrum of emission results. The absorption of this radiation by other electrons is high, however, and the absorption coefficient for radiation transport is large. The absorption coefficient is the inverse of the penetration depth of radiation, the so called "skin depth" as shown by the following equation:

$$\delta = \sqrt{2/(\omega\sigma\mu)} = \sqrt{\lambda\rho/(\pi c\mu)}$$

in which $\lambda$ is the wavelength, $\rho$ is the resistivity of the metal, c is the velocity of light in free space, and $\mu$ is the magnetic permeability. Taking, for example, a wavelength equal to 700 nm and the resistivity of tungsten at 2000° K equals 59.1 micro-ohm-cm, the value for the skin depth is 187 nm.

In a volume at uniform temperature with absorption length very much less than the dimensions of the body, the radiation photons are multiply emitted and reabsorbed a very large number of times for every one that escapes. Thus the radiation is effectively trapped with negligibly small probability of escape and the radiation flux density comes into thermodynamic equilibrium with the internal temperature. Consequently, the spectral power distribution of radiant energy within the body of the tungsten is the blackbody one at the local temperature. The emission from the surface, however, is modified by the reflecting characteristics of the surface, which constitutes a boundary between a free-electron plasma within the metal and the vacuum outside. It is well known in the art to calculate the reflectivity of such a surface from its electron density and electron collision frequency, or alternatively from its electrical conductivity. Inserting the value for tungsten reproduces reasonably well the known emittance (=1-R) of 0.45 in the visible, decreasing to 0.1–0.15 at 100 nm wavelength. Thus the spectral distribution of radiant emission from a tungsten surface has less infra-red proportionately than a blackbody at the same temperature.

It is important to note, however, that although the radiant emission spectrum of tungsten can be calculated by multiplying the blackbody spectrum of radiation internal to the tungsten by the surface transmission ("emittance"), the actual photons which are emitted come from within a few skin depths of the surface. All the internal photons are absorbed and re-emitted before they reached the surface, and only the last ones in the chain, emitted within a few skin depths of the surface, reach the surface to escape.

It is with respect to these radiation photons emitted within one or two skin depths of the surface that the principles of the present invention are applied. In accordance with the present invention reference being made more particularly to FIGS. 4A and B, the tungsten surface 24 is perforated by waveguides 22, preferably of square dimension, which are defined by inner surfaces 22 a–d which are each 350 nm in width with thickness of walls 150 nm and about 7000 nm deep.

The cavity waveguides 22 have a cutoff wavelength of 700 nm. The walls themselves will be low-Q waveguides having even shorter cutoff wavelengths. Since the walls are of order one skin depth thick (150 nm), they will insure that adjacent cavity waveguides 22 cannot couple together to give a larger cross-section and cutoff wavelength.

Internally generated radiation of longer wavelength than 700 nm directed toward the surface 24 will be reflected at the plane of the bottom of the cavities, because the cavity waveguides do not permit radiation modes greater than that wavelength. The only possible source of photons of 700 nm and longer wavelength reaching the surface is from emission within the side walls 22 a–d of the cavity waveguides themselves. However, the E-fields and H-fields of photons generated within the side walls penetrate into, and must obey continuity relations across the surface of the cavity waveguides since the walls are comparable to a skin depth in thickness, very much less than a wavelength. Since such fields are not allowed in the waveguides for wavelengths longer than 700 nm, they are not allowed within the metal walls either. Therefore, the transition probability for such emission is zero.

The only place escaping photons of longer wavelength than 700 nm can be emitted is from within one skin depth of the exposed surface faces of the separators between the cavity waveguides. These have reduced area compared to that of the original surface, about 50% for the dimensions shown in FIGS. 4A and B. Moreover, because of the thinness of the region of emission, and the absence of photons of the same wavelength arriving from the interior, the radiation flux density therein does not reach thermodynamic equilibrium, and remains below the blackbody equilibrium level. Assuming that the flux reaches 20% of the blackbody level, with the ends of the walls totalling half the surface area, the total radiant flux of wavelength longer than 700 nm will only be about one-tenth the normal value for tungsten at that temperature. Visible photons of wavelength less than the waveguide cutoff, whether internally generated or generated within the cavity waveguide walls, encounter no impediment to their emission and their flux approaches the blackbody level.

Consequently, the amount of infra-red radiation relative to visible radiation is drastically reduced. Table I calculates the lumen output and total radiation output assuming the visible radiation reaches the blackbody level while the infra-red radiation is reduced to one-tenth that of tungsten. Also given in Table I (FIG. 8) is the evaporation rate in microns of thickness/10,000 hours. At 2100° K, this amounts to 1.4% of the cavity waveguide dimension. Since this surface configuration has a much larger surface energy than a plane, evaporation and recondensation plus surface migration will act to fill and close the waveguide cavities. The still greater evaporation rate at higher temperatures would be considered to produce fatal distortions in cavity shapes in times less than 10,000 hours. Accordingly, approximately 2100° K is considered an upper limit for an operating temperature for 10,000 hours life. As set forth in Table I, this would still permit luminous efficacies of 60–80 lpw, while requiring surface areas of a few $cm^2$for 1000 lumens which provides a significant improvement in efficacy over prior art incandescent lamps.

FIG. 5 illustrates schematically the spectral power distribution of radiation from a tungsten radiator according to the prior art, while FIG. 6 represents schematically the spectral power distribution of a tungsten radiator according to the invention. The very large reduction in infra-red radiation of wavelength longer than 700 nm is readily apparent.

EMBODIMENT 3 INCANDESCENT GAS MANTLE

As discussed hereinbefore it is known in the prior art to increase the luminous efficiency of gas flame lanterns by providing a so called "mantle" in contact with the flame and heated by it to temperatures in the vicinity of 1500° K. The mantles employed in the prior art are typically composed of thorium oxide to which a small percentage of cerium oxide has been added. By virtue of having few free electrons, and having a fundamental infra-red absorption/emission band onset at wavelength longer than 5000 nm, the ceramic body of the mantle is a relatively poor radiator of infra-red radiation.

The incorporation of cerium adds absorption/emission transitions in the visible part of the spectrum, enhancing the luminous emission at 1500° K.

Consequently such so call "gas mantles" achieve luminous efficacies of 2 lumens/watt or thereabouts at 1500° K, which is more than the 0.2 lumens/watt that could be achieved with a tungsten radiator at that temperature. They are widely used in portable gas fired lanterns for application where electricity is not available.

In accordance with the present invention, reference being made to FIGS. 7A, B and C, there is illustrated an incandescent gas mantle device including a burner 26 which provides a flame 28 which heats the surrounding ceramic mantle body 30 to a selected temperature in the vicinity of 1500° K. The ceramic body mantle 30 is formed of thorium oxide to which a small percentage of cerium oxide has been added as discussed above. The mantle 30 however, is formed with perforations which form a plurality of waveguide cavities 32 (similar to the cavities of FIGS. 2 and 4) having a square lateral cross section formed by walls 34 a–d each having a width of 350 nm. Each of the waveguide cavities 32 has a length of greater than about 7000 nm.

The waveguide cavities provide for waveguides of 700 nm cutoff wavelength thereby suppressing the emission of longer wavelengths in a manner analogous to the tungsten radiator of embodiment 2. Consequently, it requires less heat from the gas flame source 26 to heat the ceramic body 30 to 1500° K, at which temperature the visible radiation is emitted as before. Thereby the fuel consumption per lumen hour (the figure-of-merit for gas filed light sources analogous to lumens/watt for electric light sources) is substantially reduced.

While the invention has been described with respect to preferred embodiments, it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrative and not in limiting sense.

I claim:

1. An energy conversion device to convert energy into electromagnetic radiation and suppress radiation at wavelengths greater than a predetermined wavelength value, said device comprising:

means to cause the emission of electromagnetic radiation in the optical region of the spectrum; and emission suppression means disposed in said device, said emission suppression means comprising an array of cavities in a body, the dimensions of said cavities being such that only radiation emitted at wavelengths less than said predetermined value can be propagated by said body;

said body permitting a predetermined wavelength value to be selected to thereby suppress at least a majority of the non-visible infra-red radiation that would otherwise be emitted by the device.

2. The device according to claim 1 wherein said means to cause emission of electromagnetic radiation comprises atoms which are excited within the cavities of said infra-red suppression means.

3. The device according to claim 1 wherein said suppression means is at least one waveguide and the excitation of said atoms occurs in said waveguide.

4. The device according to claim 1 wherein the suppression means are waveguides, said waveguides being an array of cavities, said cavities each having a cut off wavelength of about 700 nm and a depth that is significantly greater than said cut off wavelength.

5. The device according to claim 4 wherein each of the cavities is square in cross sectional shape with a width of 350 nm.

6. A discharge device for converting energy into electromagnetic radiation including a transparent enclosure means, a pair of spaced electrodes in said enclosure means, a fill of ionizable gas in said enclosure means, the improvement comprising:

means to impose an electrical potential between said electrodes;

infra-red emission suppression means forming one of the electrodes;

said emission suppression means comprising an array of cavities in a body, the dimensions of said cavities being such that only radiation emitted at wavelengths less then about 700 nm can be propagated by said body;

said body permitting the predetermined wavelength to be less than about 700 nm to thereby suppress at least a majority of the non-visible infra-red radiation that would otherwise be emitted by the device.

7. The device according to claim 6 wherein said emission suppression means is at least one waveguide and ionization of said fill of gas occurs in said waveguide.

8. The device according to claim 6 wherein said emission suppression means is an array of cavities, said cavities each having a width of about 350 nm and a depth that is greater than the width.

9. The device according to claim 8 wherein each of the cavities is square in cross sectional shape.

10. The device according to claim 6 wherein the emission suppression means is a foraminous layer of metal, each of the foramina in said layer being regularly arranged relative to adjacent foramina, each of the foramina having a width of about 350 nm and a depth significantly greater than the width, whereby to form an array of waveguides which suppress emissions from the device at wavelengths greater than about 700 nm.

11. An incandescent lamp device for converting energy into electromagnetic radiation with a radiative light source adapted to suppress radiation at wavelengths greater than about 700 nm, said lamp device comprising:

a body of metal;

means to impose an electrical potential on said body to heat it to an elevated temperature to cause the emission of electromagnetic radiation in the visible spectrum;

emission suppression means integral with the surface of said body to suppress radiation emissions from said body at wavelengths greater than about 700 nm;

said emission suppression means comprising an array of cavities in said body, the dimensions of said cavities being such that only radiation emitted at wavelengths less than about 700 nm can be propagated by said body; and transparent enclosure means surrounding said body of metal and said potential imposing means.

12. The lamp according to claim 11 wherein said cavities each have a width of less than about 350 nm, said cavities being spaced from each other at distances greater than about 150 nm, said cavities further being sufficiently deep to suppress radiation emissions greater than 700 nm.

13. The device according to claim 11 wherein the suppression means is a foraminous layer of metal, each of the foramina in said layer being regularly arranged relative to adjacent foramina, each of the foramina having a width of about 350 nm and a depth significantly greater than the width, whereby to form an array of waveguides which suppress emissions from the device at wavelengths greater than about 700 nm.

14. The lamp according to claim 11 wherein the metal is tungsten.

15. The lamp according to claim 11 wherein the cavities are each square in cross section.

16. An energy conversion device to convert energy into electromagnetic radiation and suppress radiation at wavelengths greater than a predetermined value, said device comprising:

means to cause the emission of electromagnetic radiation in the optical region of the spectrum;

emission suppression means disposed in said device comprising waveguides;

said waveguides comprising an array of cavities in a body, each of said cavities having predetermined dimensions comprising a square cross sectional shape with a width of about 350 nm, a cut off wavelength of about 700 nm, and a depth that is significantly greater than said cut off waveguide whereby the dimensions of said cavities are such that only radiation emitted at wavelengths less than said predetermined value can be propagated by said body.

17. A device providing for the emission of electromagnetic radiation substantially in the visible region of the spectrum, said device comprising:

a means providing the emission of electromagnetic radiation a cavity waveguide means coupled with the electromagnetic radiation providing means;

a cavity waveguide means coupled with the electromagnetic radiation providing means;

said cavity waveguide means comprising an array of cavities, said cavities each having a width of about 350 nm and a depth that is significantly greater than the with whereby emissions from the device at wavelengths greater than about 700 nm are suppressed.

18. The device according to claim 17 wherein each of the cavities is square in cross sectional shape.

19. A heat activated light source, said light source comprising:

a heat source means for generating thermal radiation;

a ceramic body formed of thorium oxide and an impregnant of cerium oxide dispersed in said body;

said body being positioned adjacent said heat source to receive said thermal radiation whereby said body is heated to a predetermined temperature to cause the emission of wavelengths in the optical region of the spectrum;

means to cause the emission of wavelengths in the optical region of the spectrum and suppress infrared emission at a lower heat rate to provide said predetermined temperature comprising;

emission suppression means disposed in said body; said emission suppression means comprising an array of cavities in said body, the dimensions of said cavities being such that only radiation emitted at wavelengths less than about 700 nm can be propagated by said body.

20. The heat activated light source according to claim 19 wherein said cavities each have a width of less than about 350 nm, said cavities being spaced from each other at distances greater than about 150 nm, said cavities further being sufficiently deep to suppress radiation emissions greater than 700 nm.

* * * * *

UNITED STATES PATENT AND TRADEMARK OFFICE

CERTIFICATE OF CORRECTION

PATENT NO. : 5,079,473

DATED : January 7, 1992

INVENTOR(S) : John F. Waymouth

It is certified that error appears in the above-identified patent and that said Letters Patent is hereby corrected as shown below:

Column 5, line 43, change "187" to ---18.7---.

Column 5, line 63, change "100" to ---10,000---.

Signed and Sealed this

Seventh Day of December, 1993

*Attest:*

Bruce Lehman

BRUCE LEHMAN

*Attesting Officer*

*Commissioner of Patents and Trademarks*